US006854811B2

(12) United States Patent
Buchholz et al.

(10) Patent No.: US 6,854,811 B2
(45) Date of Patent: Feb. 15, 2005

(54) METHOD FOR PRODUCING A BRUSH

(75) Inventors: Erwin Buchholz, Asbach (DE); Andreas Lanvers, Bad Honnef (DE); Richard Ramakers, Cadier en Keer (NL); Thomas Wolters, Aachen (DE)

(73) Assignee: M+C Schiffer GmbH, Neustadt/Wied (DE)

( * ) Notice: Subject to any disclaimer, the term of this patent is extended or adjusted under 35 U.S.C. 154(b) by 240 days.

(21) Appl. No.: 10/156,198

(22) Filed: May 29, 2002

(65) Prior Publication Data

US 2002/0180253 A1 Dec. 5, 2002

(30) Foreign Application Priority Data

May 31, 2001 (DE) ..... 101 26 631

(51) Int. Cl.[7] ..... A46D 1/08; A46D 3/00
(52) U.S. Cl. ..... 300/21
(58) Field of Search ..... 300/21

(56) References Cited

U.S. PATENT DOCUMENTS 4,609,228 A * 9/1986 Bickel ..... 300/4
4,807,938 A * 2/1989 Weihrauch ..... 300/21
5,033,797 A * 7/1991 Rueb ..... 300/5

* cited by examiner

*Primary Examiner*—Randall Chin
(74) *Attorney, Agent, or Firm*—Lawrence E. Laubscher, Sr.

(57) ABSTRACT

A method for producing a brush, wherein a filament bundle strand is unwound from a spool and moved past a cutting device that severs a predetermined length of the strand for connection with the bristle carrier of the brush. In order to increase productivity, airflow is used to transport the unwound strand and the severed strand length. A pressure or vacuum source is provided which communicates with the take-off guide channel and/or the guide channel and which produces in the respective channel an airflow that is effective in the direction of transport of the strand.

8 Claims, 1 Drawing Sheet

METHOD FOR PRODUCING A BRUSH

BACKGROUND OF THE INVENTION

1. Field of the Invention

The present invention relates to a method for producing a brush, especially a tooth brush, comprising the steps of unwinding a strand of a single filament or of a filament bundle from a spool and moving it past a cutting means in which a predetermined length piece of the strand is cut off, and connecting said length piece to a bristle carrier. Such a method is known e.g. from U.S. Pat. No. 2,643,158.

2. Description of the Related Art

In the case of the known method, a plurality of strands of filament bundles are unwound from spools simultaneously and supplied to a so-called perforated field plate which is installed in an injection mould later on, so as to complete the same. The unwinding of each individual strand from the spool and the introduction of the strand into the perforated field plate are carried out by mechanically clamping each individual strand. A feed means is provided with a stationary clamping device and with a movable clamping device for each strand. The movable clamping device is moved towards the stationary clamping device. During this movement, the stationary clamping device is effective, i.e. the strand is held in position. Subsequently, the stationary clamping device is released and the movable clamping device is activated. The movable clamping device is moved away from the stationary clamping device in the direction of transport. In the course of this movement, additional strand material is unwound from the spool and the front free end of the strand is also introduced in the perforated field plate.

A similar means which also touches the strands supplied is known e.g. from U.S. Pat. No. 3,408,112. German-Offenlegungsschrift 25 52 213 and e.g. German-Offenlegungsschrift 28 49 510 disclose that the strands are guided and advanced between two driven feed rolls. In comparison with the first-mentioned solution, this solution entails the problem of slip between the strand and the feed rolls. The desired feed of the strand is not reliably achieved.

In the case of the two above-mentioned methods, the strand is seized or rather clamped behind its front free end and advanced by means of said clamping, so that special care is required when threading the strand, so as to avoid kinking of the individual filament or of individual filaments of a bundle of filaments. Such kinking of the filaments will impair the process. Especially in the case of the nowadays normally used high processing speeds, such kinking will cause high reject rates and, in some cases, the whole production process will be brought to a standstill.

In addition, the conveying means which are known from the prior art and which serve to unwind and advance the strand for connecting the same to a bristle carrier later on, have a structurally conditioned inertia. This limits the maximum possible processing speed. The mechanical parts are, moreover, complicated as far as their structural design is concerned and they necessitate a great deal of maintenance work.

SUMMARY OF THE INVENTION

The present invention is based on the problem of providing a method of the type mentioned at the start which is used for producing a brush and which allows a higher productivity. In addition, the present invention is based on the problem of providing an apparatus which is suitable for executing said method and whose structural design is less complicated than that of known apparatuses.

In order to solve the problem as far as the method is concerned, the present invention further develops the method referred to at the start in such a way that, after having been cut to length, the strand which has been unwound from the spool and/or the length piece is/are advanced in the direction of transport by an airflow.

In accordance with the method according to the present invention, the strand is first cut off the endless material wound on the spool. Transport of the length piece is carried out only after this cutting step. During said transport, the circumferential surface of the strand is not directly acted upon by a conveying means. On the contrary, the length piece is conveyed in a contact-free manner by an airflow flowing in the direction of transport and acting on the circumferential surface of the strand. By means of the airflow, substantially higher conveying speeds of the length piece can be achieved, in particular since the length piece is no longer connected to the material on the spool when it is being conveyed. In addition, the airflow can be rendered effective via valves within a very short period of time. The structurally conditioned inertia of the conveying means known from the prior art does not exist. Furthermore, a kinking of individual filaments will be prevented when the method is executed in the manner described in the present invention. Since the filaments are not clamped, forced transport of the filaments against a resistance does not take place. In addition, it turned out that the filaments will first stick to a possible resistance, but then find their way together with the airflow.

In combination with this way of executing the method or alternatively thereto, also the endless strand can be conveyed in the direction of transport through a force which is produced by an airflow, so as to achieve the above-mentioned advantages. The speed in the case of this alternative suggestion according to the present invention can be increased still further in that the spool is rotated by a driving force so as to keep a sublength of the strand ready for use, which can be supplied by the airflow towards the cutting means, so that the force required for rotating the spool need not be produced by the airflow as well.

In accordance with a preferred further development of the method according to the present invention, the length piece is guided in a guide channel towards a plate provided with retaining channels, preferably a perforated field plate covering a die cavity of an injection mould, and is introduced by means of the airflow into one of the retaining channels. Following this, the length pieces introduced in the perforated field plate are moved only together with said perforated field plate. In other words, transport of the length piece in its critical phase, i.e. prior to the insertion in a retaining channel of the perforated field plate, is effected by the airflow alone. It turned out that, even if a considerable angular displacement exists between the guide channel and the retaining channel, kinking or entangling need not be reckoned with when the length piece is being introduced in the respective retaining channel. A brush prepared in this way can have various oblique, in some cases intersecting bristle bundles.

Another preferred embodiment of the method according to the present invention is so conceived that, for cutting the length piece to length, the front end face of the strand is caused to knock against a stop surface and that the length piece is then cut to length. This will guarantee that, especially in cases in which a bundle strand is used, all the filaments of the strand are cut off at the same length.

This further development of the present method can be executed in a particularly effective manner when, after cutting off the length piece, the stop surface is moved essentially transversely to the longitudinal axis of said length piece, and when a passage opening arranged in the vicinity of the stop surface is arranged in alignment with the length piece, the length piece being advanced through said passage opening so as to fasten it to the bristle carrier. This way of executing the method permits a high output and the desired length of the length piece will be observed reliably.

In accordance with a further preferred embodiment of the present invention, the use-side ends of the individual filaments of a filament bundle are arranged in a simple manner in an enveloping surface deviating from a plane surface. According to this further development, the length piece is axially displaced through the passage opening and the filament bundle is longitudinally contoured by axially displacing the filaments relative to one another before it has reached a final position at which the rear end of the length piece projects beyond the passage opening.

In a manner known per se, preparation of the filaments, which have been cut to length and advanced in this way, preferably takes place in that the rear end of the length piece, which projects beyond the passage opening, is partially melted, if necessary after previous cutting to size, when it has reached said final position. The individual filament or all the filaments of a strand are in this way prepared for future fastening to a bristle carrier by encompassing the filaments in question with a plastic component by means of injection moulding.

According to another preferred embodiment of the present invention, the front ends of the endless material wound on the spool are brought to a defined position in that the strand supplied from the spool is pressed against the cutting means during transport of the length piece. This has the effect that defined starting conditions are produced before the strand is advanced, is cut to length so as to form a defined length piece, and is finally cut off the endless material.

The method according to the present invention can be accelerated and simplified still further in that also for the purpose of unwinding the strand from the spool an airflow is caused to pass along the circumference of the strand. It follows that an airflow is used not only for supplying the endless material to the cutting means and for advancing the length piece, which has been cut to length, but also for unwinding the endless material from the spool.

For solving the above task as far as the apparatus is concerned, the present invention suggests that an apparatus for producing a brush, especially a tooth brush, which is known per se from the prior art and which comprises at least one spool keeping a wound-up strand of a bristle filament or of a filament bundle ready for use, a first guide means with a take-off guide channel for each strand, a second guide means following said first guide means and provided with a guide channel which is in alignment with said take-off guide channel, a blade cutting the supplied strand to length, and a conveying means drawing on the strand and used for unwinding said strand from the spool, should be further developed in such a way that a pressure source or a vacuum source is provided, which communicates with the take-off guide channel and/or the guide channel and which produces in said take-off guide channel and said guide channel, respectively, an airflow which is effective in the direction of transport of the strand. In the case of the structural design of the apparatus according to the present invention, mechanical means clamping the circumference of the strand and seizing and conveying the bristles for fastening them to the brush body can be dispensed with fully or partly. It follows that the apparatus for producing a brush, especially a tooth brush, according to the present invention is much less complicated than the apparatuses mentioned at the start and it is less susceptible to faults.

Preferably, the second guide means comprises a clamping means which acts on the outer circumferential surface of the strand so that the strand guided by said second guide means can be clamped and secured in position in the guide means after having been advanced by an arbitrary distance. Length pieces of deviating lengths can be adjusted in a simple manner in this way.

Alternatively or in combination with such a clamping means, a stop surface cooperating with the front end of the strand can preferably be provided, said stop surface being arranged after the second guide means and positioned at a distance from the blade which corresponds to the length of a cut-off length piece. Such a stop should preferably be used in cases in which all or almost all the length pieces of the bristles which are to be formed on the brush have an identical length.

Alternatively, it is also possible to provide a stop which is variable with respect to the longitudinal axis of the length pieces. The length of each individual length piece can be adapted individually in this case.

A particularly simple structural design of the apparatus according to the present invention is preferably achieved on the basis of the fact that the above-mentioned stop surface is formed on a perforated field plate covering a die cavity of an injection mould. Instead of being provided on a perforated field plate, the stop may also be provided on an intermediate plate having at least one hole for receiving the length piece which has been cut to length. This intermediate plate has at least one, preferably a plurality of holes for receiving the length piece. These holes are implemented such that it is less difficult to introduce the length pieces into these holes. The length pieces produced are transferred from said holes to the perforated field plate. For this purpose, the intermediate plate is preferably moved to a transfer station where the perforated field plate is present as well. In accordance with another preferred embodiment of the apparatus according to the present invention, the perforated field plate or the intermediate plate are movable in a direction which is essentially perpendicular to the longitudinal dimensions of the strand. It follows that the distance between the perforated field plate or the intermediate plate and the cutting means can be varied between the cutting operations in which the individual length pieces are cut to length. Length pieces of different lengths are produced. Alternatively, a stationary, or, in particular, a movable stop can be provided on the side of the perforated field plate or of the intermediate plate facing away from the guide means. In the case of this embodiment, the length piece is cut off the endless strand only after having been introduced in the perforated field plate or in the intermediate plate and after having encountered the movable stop.

BRIEF DESCRIPTION OF THE DRAWING

Further details, advantages and features of the present invention can be seen from the following description of an embodiment in connection with the drawing. The drawing shows a schematic representation of an embodiment of an apparatus for producing a tooth brush.

DETAILED DESCRIPTION

Figure 1:
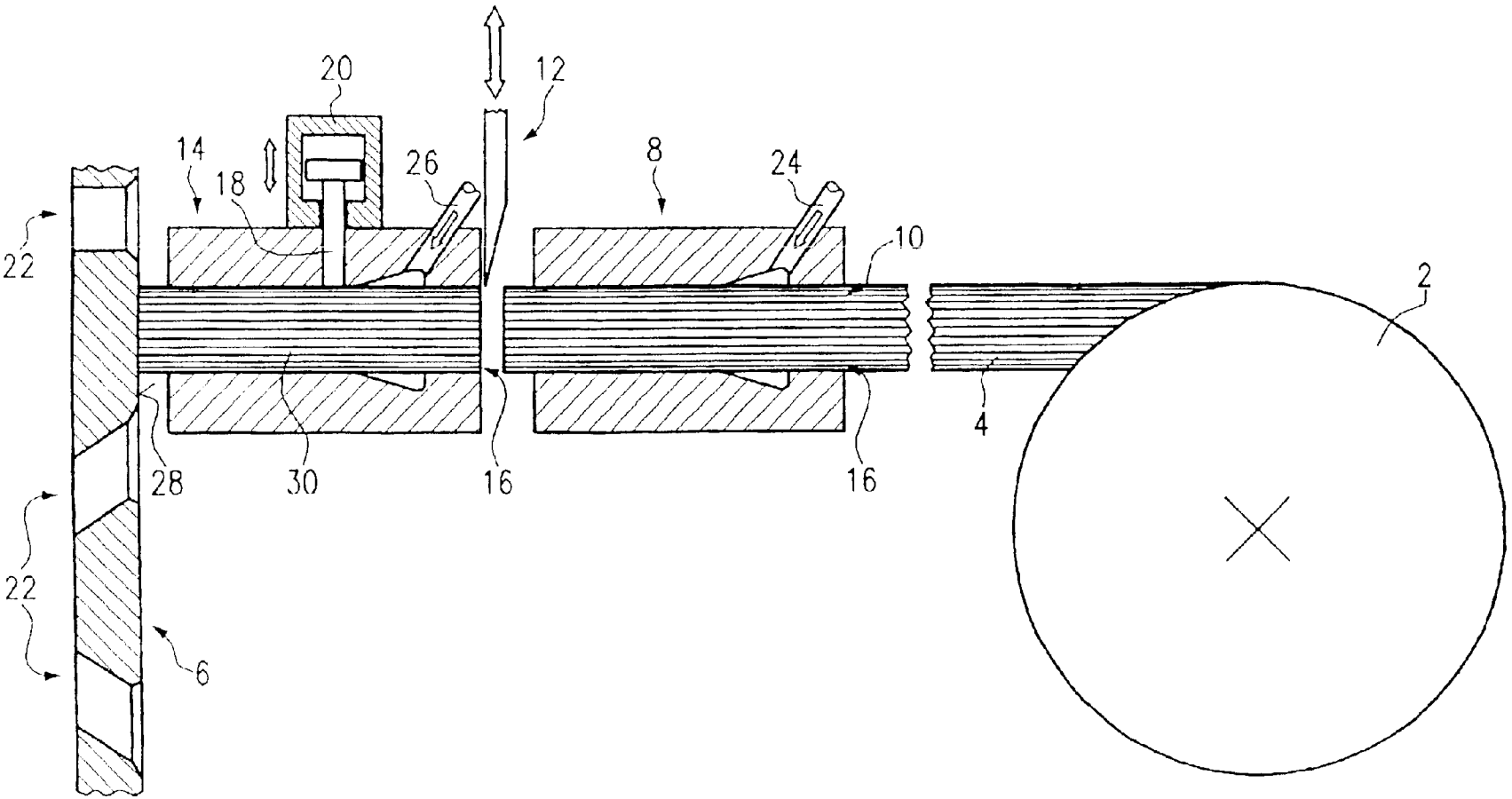

The embodiment shown in the drawing is used for cutting to length and feeding a filament-bundle strand 4 stored on a schematically outlined spool 2. From this spool 2 the strand 4 is introduced into a perforated field plate 6, after having been cut to size previously. The apparatus comprises first guide means 8 having a take-off guide channel 10. The endless strand 4 is introduced in this take-off guide channel 10. A movable blade 12 is arranged behind the first guide means 8, when seen in the direction of transport. This blade 12 is followed by a second guide means 14 having a guide channel 16 which is in alignment with the take-off guide channel 10. A clamping plunger 18 is adapted to be moved approximately at right angles to the guide channel 16, said clamping plunger being extended such that it defines a reciprocating piston of a double-acting pneumatic pressure cylinder 20. This pressure cylinder 20 is connected to the second guide means 14. The perforated field plate 6 is held in the vicinity of the front end face of the second guide means 14. This perforated field plate 6 is provided with a plurality of retaining channels 22 for accommodating bristle bundles and it is adapted to be moved in a direction that is perpendicular to the longitudinal dimensions of the second guide means.

The take-off guide channel 10 communicates via a pressure line 24 with a pressure source, which is not shown. Likewise, the pressure source is connected via a pressure line 26 to the guide channel 16. The two pressure lines 24 and 26 open into an annular channel which surrounds the channels 10, 16 in an annular pattern and by means of which the airflow is oriented substantially parallel to the longitudinal dimensions of the channels 10, 16 and in the direction of transport of the strand 4. It follows that, in the embodiment shown, a defined airflow is produced in the channels 10, 16 by overpressure.

By means of this defined airflow, the strand 4 is first transported in the first guide means 8 towards the perforated field plate 6. The strand 4 enters the second guide means 14 with its front free end. Also in said second guide means 14 an airflow acts on the strand, at least on the circumference thereof, and continues the transport of said strand in the direction of the perforated field plate 6. This perforated field plate 6 is initially arranged in such a way that none of the inlet openings of the retaining channels 22 located adjacent the second guide means is in alignment with the guide channel 16. The front end of the strand 4 will therefore first knock against a stop surface 28 formed on the perforated field plate 6. The desired length of a length piece is adjusted in this way. Subsequently, the blade 12 cuts a length piece 30, which is held in the second guide means, off the endless strand 4 by an advance movement at right angles to the longitudinal direction of the strand. During this cutting operation, at least the pressure line 24 is preferably separated from the pressure source by a controllable valve.

The perforated field plate 6 is now displaced relative to the second guide means 14 and an inlet opening of the retaining channel 22 is arranged in alignment with the guide channel 16. Due to the airflow prevailing in the guide channel, the length piece 30 is transferred to the retaining channel 22. Simultaneously, the pressure source of the first guide means 8 can be activated so as to press the supplied endless strand 4 with all its filaments against the surface of the blade 12. The perforated field plate 6 is again displaced relative to the second guide means 14 so as to arrange the stop surface 28 or another stop surface, which is defined in the vicinity of an inlet opening of another retaining channel 22, in alignment with the guide channel 16. The blade 12 is returned to its starting position, shown in FIG. 1, so as to open the passage from the first guide means 8 to the second guide means 14. The endless strand 4 impinges once more on the stop surface. The above-described process is repeated, the only difference being that another retaining channel is now arranged such that its inlet opening is in alignment with the guide channel and is then equipped with another length piece.

If a length piece with a shorter length is to be produced, the clamping plunger 18 can clamp the circumference of the strand introduced in the guide means. Alternatively, there may also be provided various slide members which fully penetrate the guide channel 16 and against which the front end of the endless strand knocks. In this case, a stop surface is defined by a respective one of the slide members.

In accordance with an alternative embodiment, the stop surface may be provided behind the perforated field plate 6. Such a stop surface is preferably displaceable in the longitudinal direction of the endless strand 4 supplied. In this case, the endless strand is first pushed through the retaining channel 22 of the perforated field plate until the front end face thereof knocks against the stop. Subsequently, the length piece 30 is cut off. The perforated field plate is displaced so as to arrange another retaining channel again in alignment with the endless strand 4 supplied. Prior to a further supply of the endless strand, the distance between the stop and the perforated field plate may be changed, if desired, so as to modify, in comparison with the previously produced length piece, the length of the length piece which is now to be cut.

Alternatively to the embodiment shown in the FIGURE, an intermediate plate may also be provided instead of the perforated field plate, said intermediate plate having at least one, preferably a plurality of holes for receiving therein the length pieces. These holes are filled with length pieces at one go. Following this, the intermediate plate is moved to a transfer station where the holes formed in the intermediate plate are positioned such that they are superimposed on the respective retaining channels of a perforated field plate. The length pieces are then pushed out into the retaining channels. The holes of the intermediate plate are preferably larger than the holes of the retaining channels. The bristle bundles can thus be transferred more easily from the guide means to the intermediate plate.

In the embodiment shown, the endless strand 4 is unwound from the spool 2 in the circumferential direction. With respect to a twist of the endless strand in its front unwound portion, which will facilitate handling of the strand, it may be more advantageous to unwind the endless strand 4 tangentially over the head of the spool 2. The endless strand 4 is in this case unwound from the spool 2 essentially in the direction of the central longitudinal axis of the spool 2.

List of Reference Numerals

2 spool
4 endless strand
6 perforated field plate
8 first guide means
10 take-off guide channel
12 blade
14 second guide means
16 guide channel
18 clamping plunger
20 double-acting pressure cylinder
22 retaining channel
24 pressure line
26 pressure line
28 stop surface
30 length piece

What is claimed is:

1. A method of producing a brush, comprising:

(a) unwinding a filament bundle strand from a spool;

(b) advancing the filament strand through first guide channel means toward filament strand cutting means;

(c) severing a predetermined length from the filament strand;

(d) advancing the severed filament strand length through second guide channel means for connection with a bristle carrier; and (e) said filament strand being transported through at least one of said first and second guide channel means by an airflow introduced into said guide channel means in an annular pattern around the circumference of the filament strand.

2. A method according to claim 1, characterized in that the severed filament strand length is transported by the air flow toward the die cavity of an injection mold via at least one retaining channel formed in a perforated plate.

3. A method of producing a brush, comprising:

(a) unwinding a filament bundle strand from a spool;

(b) advancing the filament strand through first guide channel means toward filament strand cutting means;

(c) severing a predetermined length from the filament strand;

(d) advancing the severed filament strand length through second guide channel means for connection with a bristle carrier;

(e) said filament strand being transported through at least one of said first and second guide channel means by an airflow introduced into said guide channel means in an annular pattern around the circumference of the filament strand; and (f) said severed filament strand length being transported by the air flow toward the die cavity of an injection mold via at least one retaining channel formed in a perforated plate, said severed filament strand length being deflected as it is introduced into the perforated plate retaining channel.

4. A method for producing a brush, comprising:

(a) unwinding a filament bundle strand from a spool;

(b) advancing the filament strand through first guide channel means toward filament strand cutting means;

(c) severing a predetermined length from the filament strand by causing the front end face of the strand to abut against a stop surface defined on a perforated plate spaced from the cutting means;

(d) advancing the severed filament strand length through second guide channel means and through a retaining channel contained in said perforated plate for connection with a bristle carrier; and (e) said filament strand being transported through at least one of said first and second guide channel means by an airflow introduced into said guide channel means in an annular pattern around the circumference of the filament strand.

5. A method according to claim 4, characterized in that, when the severed strand length piece has been cut off, the stop surface is moved essentially transversely to the longitudinal axis of said length piece, and that a passage opening arranged in the vicinity of the stop surface is arranged in alignment with the length piece and the length piece is advanced through said passage opening so as to fasten it to the bristle carrier.

6. A method according to claim 5 characterized in that the severed length piece comprises a filament bundle that is axially displaced through the passage opening and that the filament bundle of the length piece is contoured by axially displacing the filaments relative to one another before it has reached a final position at which the rear end of the length piece projects beyond the passage opening.

7. A method according to claim 6, characterized in that the rear end of the length piece is partially melted, after previous cutting to size, when it has reached said final position.

8. A method according to claim 4, characterized in that the strand supplied from the spool is pressed against the cutting means before length piece is cut off.

* * * * *